US007387817B2

(12) United States Patent
Becze et al.

(10) Patent No.: US 7,387,817 B2
(45) Date of Patent: Jun. 17, 2008

(54) METHOD FOR MASKING A WORKPIECE BEFORE ENCAPSULATION IN A CASTING BLOCK

(75) Inventors: Charles Becze, LaPrairie (CA); Brian Burgess, Dartmouth (CA); Terry Magdy, Hammonds Plains (CA); Kevin Sampson, Lantz (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 448 days.

(21) Appl. No.: 11/092,680

(22) Filed: Mar. 30, 2005

(65) Prior Publication Data

US 2006/0222773 A1 Oct. 5, 2006

(51) Int. Cl.
*B05D 1/32* (2006.01)

(52) U.S. Cl. ..... 427/282; 427/272

(58) Field of Classification Search ..... 427/282, 427/272

See application file for complete search history.

(56) References Cited

U.S. PATENT DOCUMENTS 3,790,152 A 2/1974 Parsons
4,743,462 A 5/1988 Radzavich et al.
5,013,014 A 5/1991 Mushardt
5,826,866 A 10/1998 Becker et al.
5,902,647 A 5/1999 Venkataramani et al.
5,914,060 A 6/1999 Flis et al.
5,928,534 A 7/1999 Flis et al.
5,947,662 A 9/1999 Becker et al.
5,985,122 A 11/1999 Conner
6,004,620 A 12/1999 Camm
6,244,492 B1 6/2001 Kupetz et al.
6,265,022 B1 7/2001 Fernihough et al.
6,592,948 B1 7/2003 Fusaro, Jr. et al.
6,616,969 B2 9/2003 Pfaendtner et al.
6,821,564 B2 11/2004 Das et al.
2001/0055650 A1* 12/2001 Pfaendtner ..... 427/255.39

OTHER PUBLICATIONS

"Shape Memory Alloys and Their Applications" R. Lin, website, Dec. 2004, 7 pages.*
MSN Encarta Website Dictionary for "foil".*
Google Dictionary Definition for "metal foil".*

* cited by examiner

*Primary Examiner*—Fred J. Parker
(74) *Attorney, Agent, or Firm*—Ogilvy Renault LLP

(57) ABSTRACT

A method of masking a surface of a gas turbine engine component wherein the ability of a masking member to retain the shape of the surface to which it is applied is used as a primary fixing strategy to releasably hold the masking member in position over the surface of the gas turbine engine component.

11 Claims, 7 Drawing Sheets

METHOD FOR MASKING A WORKPIECE BEFORE ENCAPSULATION IN A CASTING BLOCK

TECHNICAL FIELD

The invention relates generally to a method of masking selected portions of a workpiece during manufacturing thereof.

BACKGROUND OF THE ART

Methods of encapsulating in a casting block a workpiece poorly configured for direct gripping or clamping on a machine tool or the like are presently known. Also known, is the use of adhesive backed foil to mask the workpiece prior to encapsulation to protect the encapsulated surface of the workpiece from damage or contamination. A problem resulting from the use of such adhesive backed foil to mask the workpiece lies in that interstitial spaces between the foil and the surface being masked become difficult to avoid because of the adhesive layer. The existing interstitial spaces give rise to unwanted movement of the workpiece during treatment or machining as the workpiece is poorly secured within the casting block. Consequently, numerous workpieces are discarded due to imprecise machining or errors in treatment caused by the uncontrollable movement of the workpiece.

Furthermore, once the adhesive backed foil is removed, an undesirable residue is left on the surface of the component. Time and effort are wasted to properly clean the surface, which results in non-optimal productivity.

Accordingly, there is a need to provide an improved method of masking a workpiece that addresses the issues raised above.

SUMMARY OF THE INVENTION

It is therefore an object of this invention to provide an improved method of temporarily masking a component.

In one aspect, the present invention provides a method of masking a surface of a gas turbine engine component, the method comprising the steps of:

providing a masking member having the ability to retain the shape of the surface to which the masking member is applied; and providing a masking member having the ability to retain the shape of the surface to which the masking member is applied; and using said ability as a primary attachment to releasably fix the masking member in position over the surface of the gas turbine engine component.

In another aspect, the present invention provides a method of temporarily protecting a surface of a gas turbine engine component while the same is being processed, the method comprising the steps of: fixing an adhesive-free foil in position on a surface of the gas turbine engine component by directly laying the foil against the surface in conformity to a shape of said surface, the frictional contact between the adhesive-free foil and the surface maintaining the adhesive-free foil in position on the gas turbine component, processing the gas turbine engine component, and removing the adhesive-free foil from said surface.

In another aspect, the present invention provides method of holding a component during processing thereof, the method comprising the steps of:

providing a foil having the ability to retain the shape of the component to which the foil is applied; and fixing the foil in position over a portion of the component by plastically deforming the foil in close fitting relation with the component, and encapsulating the portion of the component covered by the foil in a body of hardenable material.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
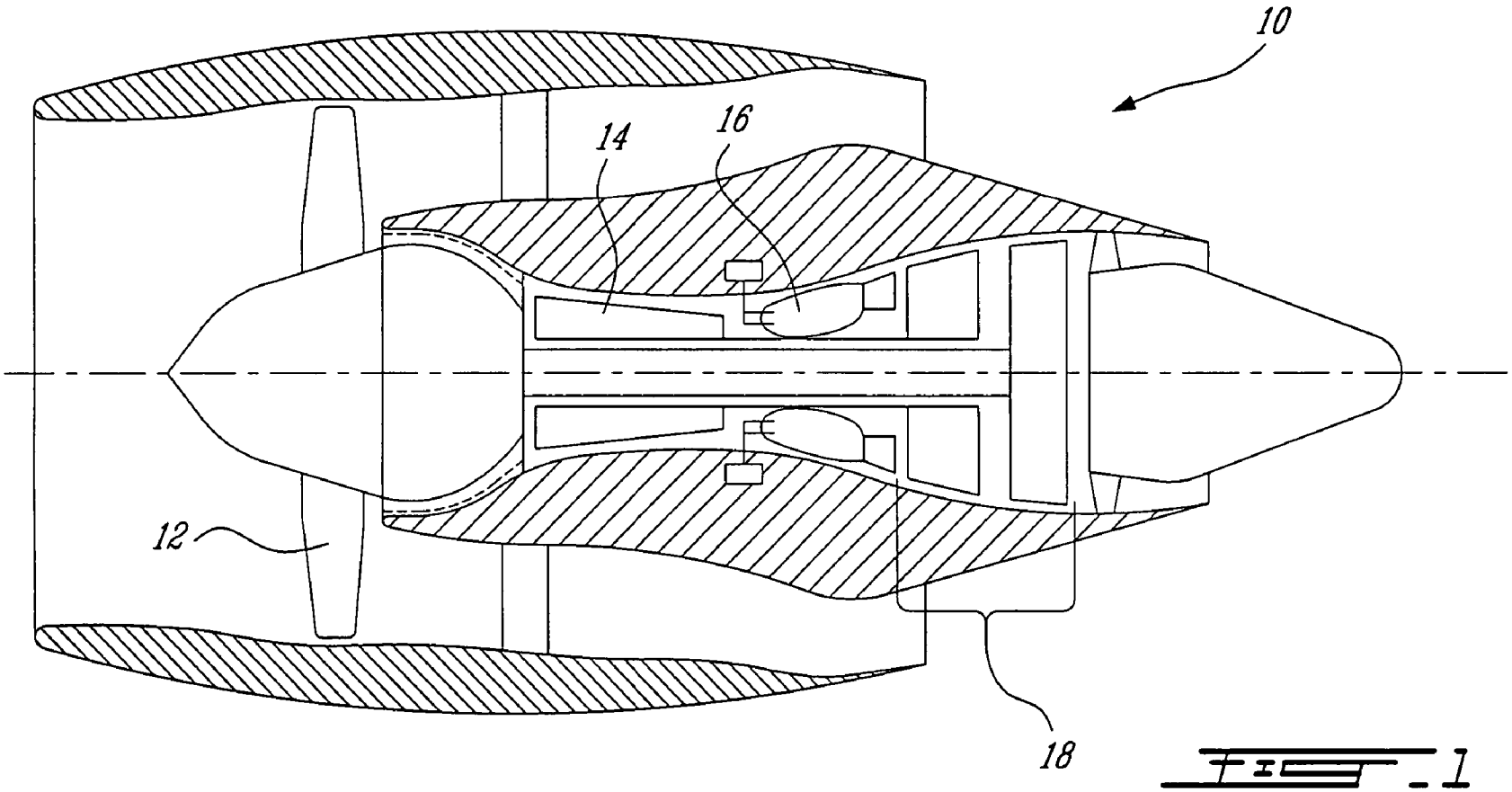
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
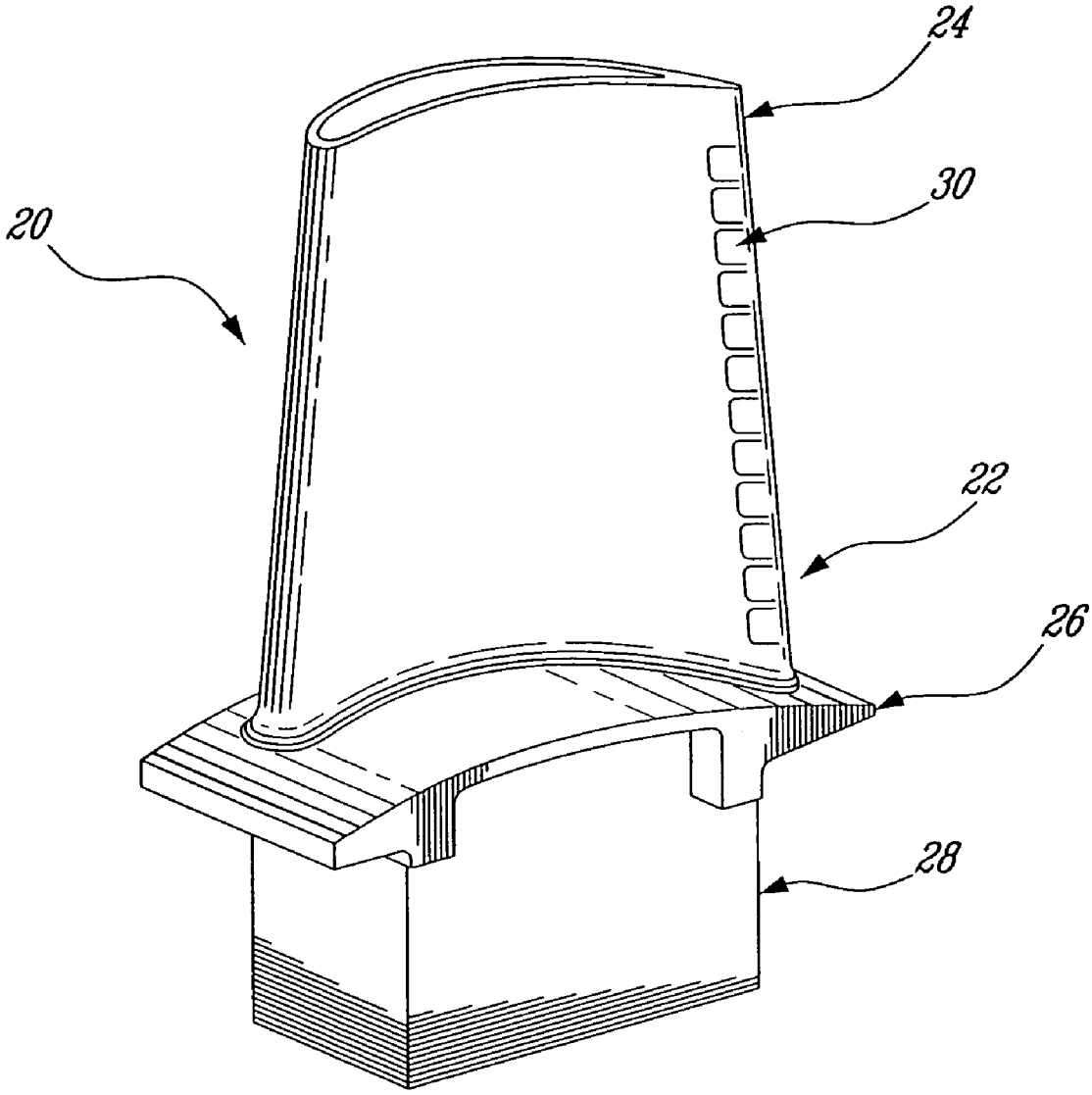
FIG. 2 is a perspective view of an unfinished gas turbine blade of the gas turbine engine shown in FIG. 1.

FIG. 2 shows a component 20 of a gas turbine engine 10, and more particularly the component 20 illustrated is a turbine blade 22. The turbine blade 22 includes an airfoil 24, a platform 26 and a dovetail 28, the latter depicted in a pre-machined state. The airfoil 24 has cooling air discharge holes 30. Notably, one cooling air discharge hole configuration is exemplified in FIG. 2 but others exists. A flow of cooling air is directed internally through the airfoil 24 to cool the same during engine operation. The cooling air is discharged from the airfoil 24 through the cooling air discharge holes 30 into the hot combustion gases flowing over the airfoil 24.

Figure 6:
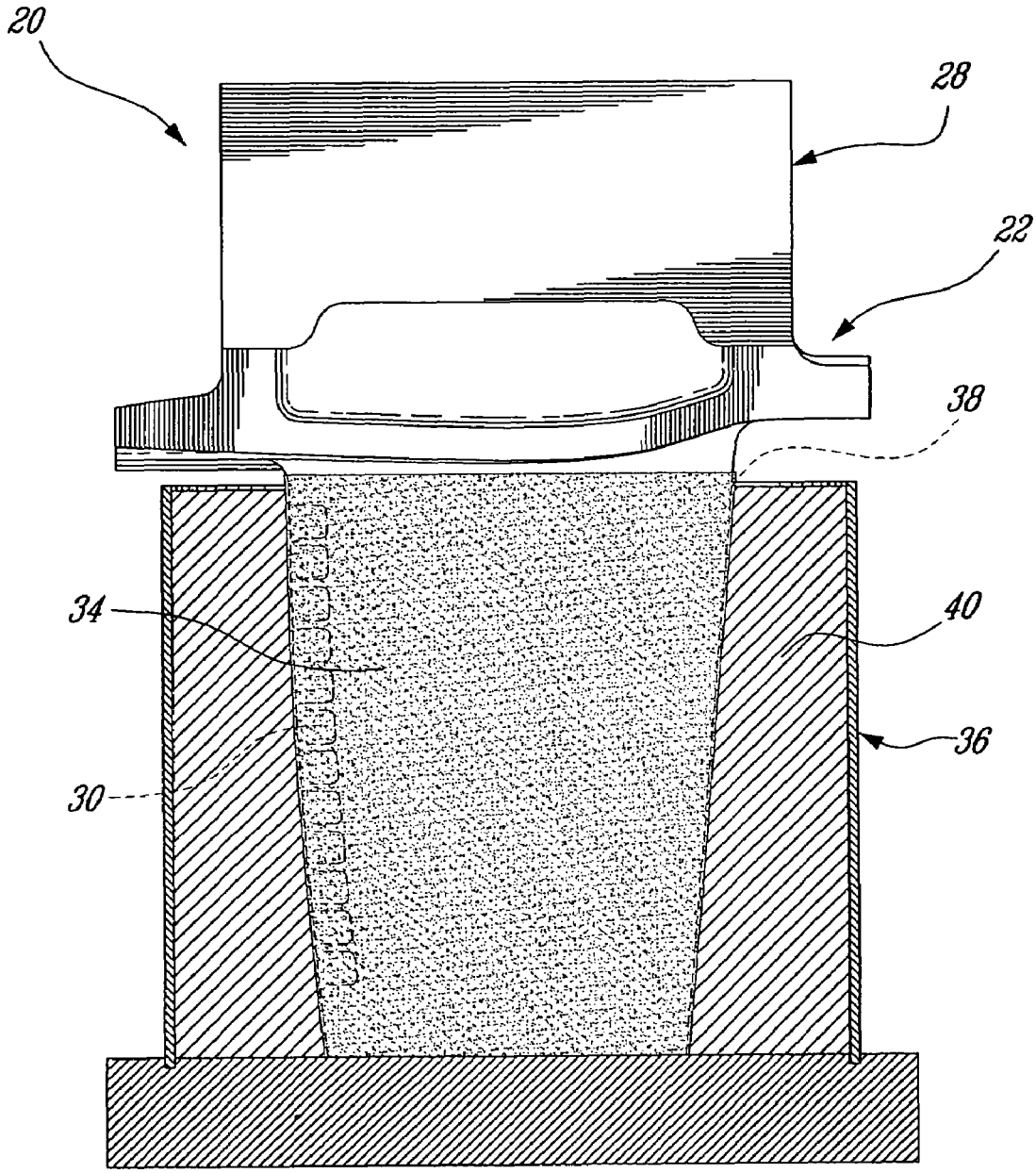
FIG. 6 is a cross-sectional elevation view illustrating the encapsulation of the turbine blade in the fixture.

The airfoil 24 of the turbine blade 22 is not readily suited for direct gripping or clamping to permit machining of the dovetail 28 to its final profile. Accordingly, the already-machined airfoil portion 24 of the blade 22 is cast into a so-called "casting block" which encapsulates the blade 22 up to the platform 26, leaving exposed the dovetail 28 to be machined, as shown in FIG. 6. Prior to encapsulation, the airfoil 24 is covered with a heat resistant flexible sheet-like masking material 32.

The masking material 32 should be at least long enough to overlie the airfoil 24 in a single layer. The airfoil 24, which is the area to be encompassed by encapsulation, is masked so as to prevent the cooling air discharge holes 30 from getting blocked during the encapsulation process. Also, the step of masking allows for a robust way of protecting the smooth surface of the airfoil 24 from getting damaged and/or getting contaminated due to alloying elements. In addition the functional purpose of the mask is to provide a buffering material to reduce the risk of coating crack due to decapsulation. Naturally, other advantages commonly known in the art exist.

More particularly, the masking material 32 may comprise an adhesive-free low or zero shape memory foil 34 that optimally combines the properties of temperature stability, flexibility and surface adherence without adhesive. The advantage of using this type of masking material 32 lies in that the nature of the low shape memory foil 34 allows the latter to conform to the exact shape of the component 20, which in this exemplary embodiment is an airfoil 24, but does not require adhesive to remain in the desired shape. The low memory foil 34 can be easily formed having no spring-back when bent. The foil 34 has the ability to retain the shape of the component to which it is applied, thereby allowing the foil to be mechanically fixed by itself in position on the component to be masked. The low memory foil 34 complements the surface of the component 20 such that it is exactly geometrically matched thereto (FIG. 4); thus, allowing for non-adhesive based masking. The foil 34 is preferably selected to have the ability to "cling", that is, to adhere to itself or to form a tight seal with the surface of the component to which it is applied.

According to one embodiment, the low memory foil 34 is provided in the form of an annealed nickel foil which is a highly dimensionally repeatable material possessing all the characteristics identified above. Nickel is preferred because it is relatively inexpensive while exhibiting excellent mechanical properties. Nickel can sustain high pressures and temperatures. The low memory foil characteristics make it possible to optimize the process of firmly fixing the component 20 by way of encapsulation so that is may be machined or treated thereafter.

Figure 3:
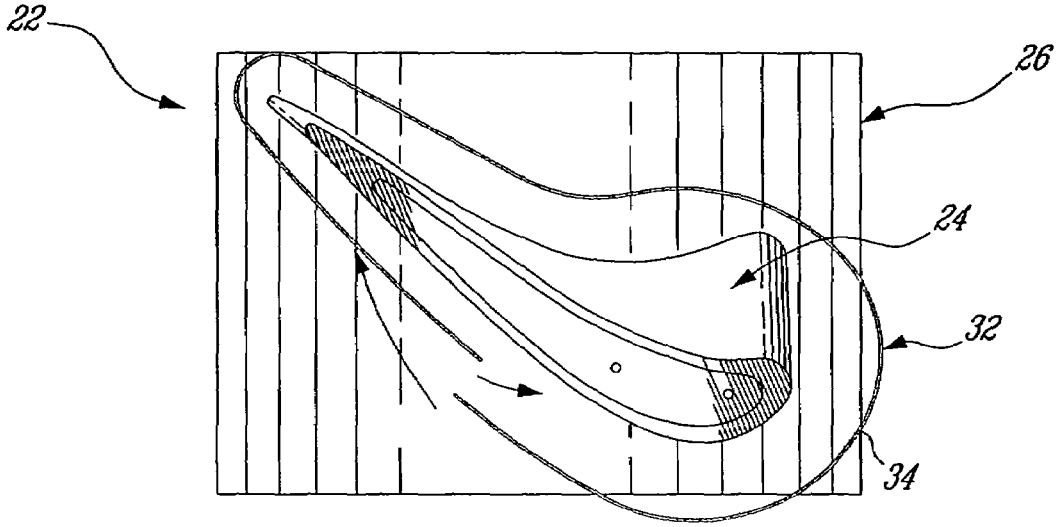
FIG. 3 is a top plan view of the turbine blade in the process of being covered by a masking material in accordance with an embodiment of the present invention.
Figure 4:
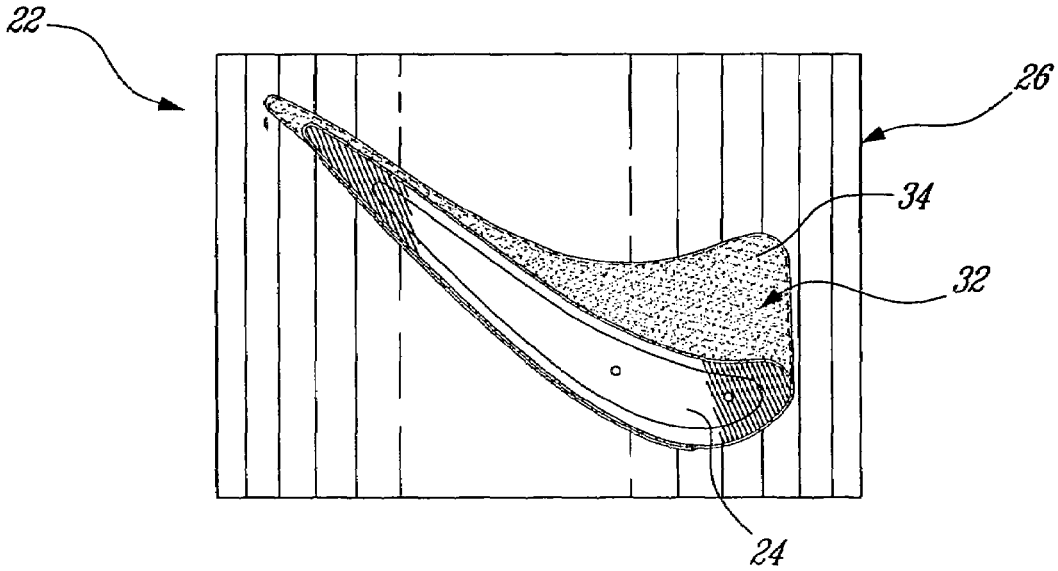
FIG. 4 is a top plan view of the turbine blade partly masked by the masking material.

As shown in FIGS. 3 and 4, the foil 34 is tightly wrapped about the airfoil 24 to adhere closely and firmly over the entire surface thereof. A single layer of foil 34 is typically applied. The opposed end portions of the foil 34 are overlapped and pressed together in close fitting relation. Depending on the intended application, the foil 34 could be only applied on a predetermined portion of the surface area, for instance along the trailing edge of the blade 22. The foil 34 can be conformed to the contour of the airfoil 24 by hands or, alternatively, a foil dispensing tool can be used. Foils having clinging properties will cling in closed conformity to the shape of the component to which they are applied. However, irrespective of its clinging properties, the ability of the foil 34 to retain the shape of the component to which it is applied (the low memory material characteristic) is used as the primary attachment means for releasably fixing the foil 34 in position over the surface to be masked. This advantageously obviates the need to resort to an adhesive to secure the foil 34 in position over the surface to be masked. The foil 34 is in direct frictional contact with the surface to be covered, thereby eliminating any buffering layer therebetween that could give rise to unwanted relative tilting movements of the component relative to the foil 34.

Figure 5:
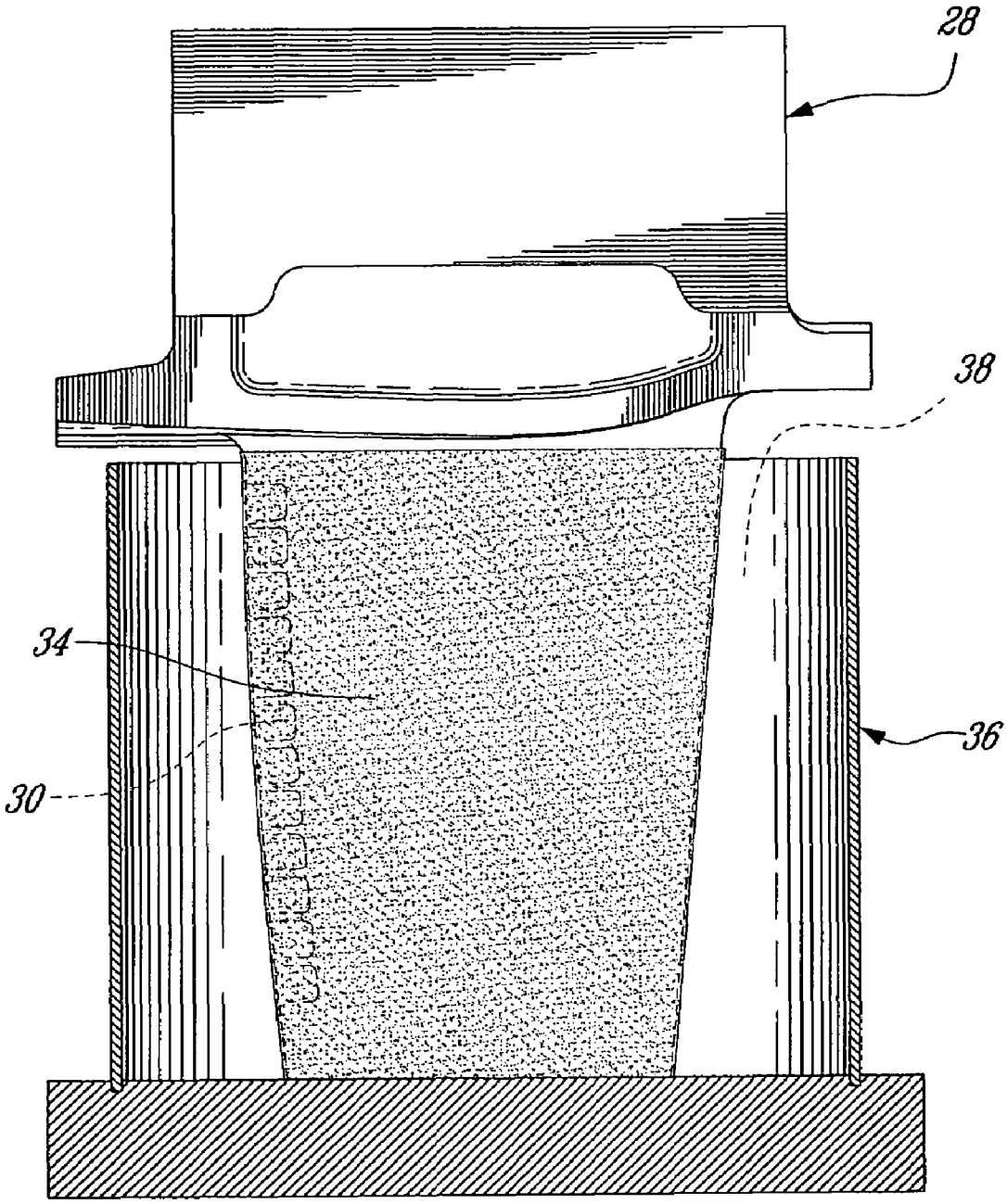
FIG. 5 is a cross-sectional elevation view of a fixture in which the covered portion of the turbine blade is installed.

Once the airfoil 24 has been masked with the foil 34 as illustrated in FIG. 4, the turbine blade 22 is ready to be encapsulated in a fixture 36 as depicted in FIG. 5.

The fixture 36 is depicted as a box, but it should be understood that it may assume any convenient shape for holding the component 20 that is to be machined or treated. Thus, the fixture 36 includes a cavity 38, adapted to accept the component 20, having a shape roughly corresponding to the contour thereof. The cavity 38 is configured to encapsulate the component 20 up to the free portions to be treated or machined.

In the exemplary embodiment shown in FIG. 5, the airfoil 24 is inserted into the cavity 38 following masking such that the platform 26 and dovetail 28 protrude therefrom. The space remaining in the cavity 38 following insertion of the component 20 is filled with hardenable casting material 40. Suitable casting materials include casting resins, molten metals or metal alloys, or molten plastics.

Once the casting material sets around the imbedded end or airfoil 24 of the component 20, it is securely held in place, as shown in FIG. 6. More specifically, the casting material 40 solidifies such that it is in contact with the low memory foil 34 but not with the masked surface of the airfoil 24. Due to the fact that the foil 34 is snugly form-fitted to the contour of the airfoil 24, the casting material 40 firmly holds the latter such that it is substantially immovable.

Figure 7:
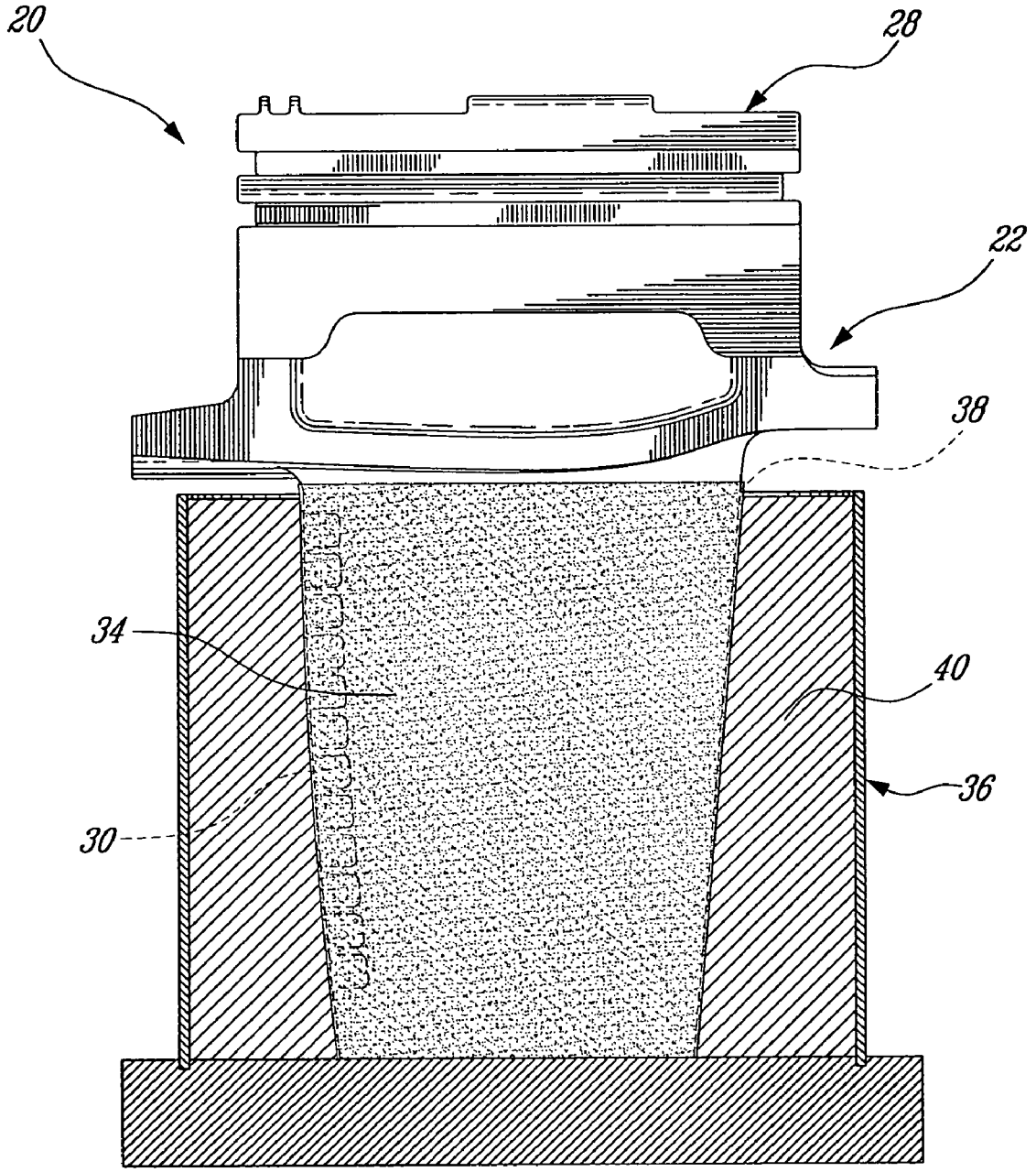
FIG. 7 is a cross-sectional elevation view of the fixture illustrating the turbine blade after the root portion thereof has been machined to its final dovetail profile.

Thus, the free end extending out of the casting block 36, which consists of the platform 26 and dovetail 28 in this case, can be treated or machined by simply fastening the fixture 36 onto a machine tool or the like. FIG. 7 illustrates the dovetail 28 post machining still fixed within the casting block 36.

Figure 8:
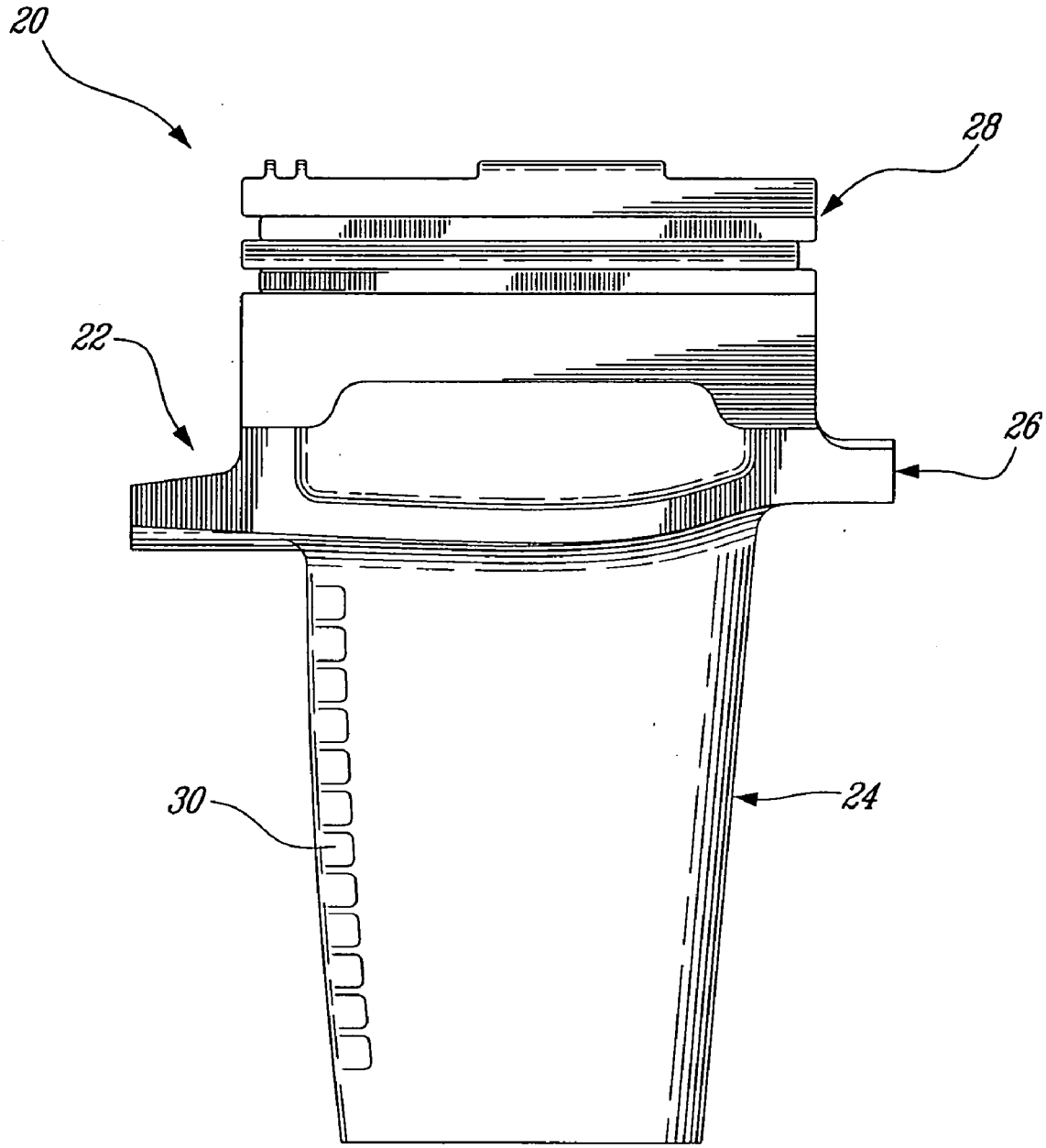
FIG. 8 is an elevation view of the turbine blade after it has been removed.

Following treatment or machining, the component 20 is released from the casting material 40 and removed from the casting block 36 by methods known in the art. Subsequently, the low memory foil 34 is removed from the surface of the airfoil 24 simply by unwrapping it therefrom or, alternatively, it can be ejected with the casting block 36. Thus, the inconveniences associated with the use of an adhesive, such as removing a residual film from the airfoil 24 surface, are thereby eliminated. Also, the utility of the low memory foil 34 extends to keeping the cooling holes 30 unblocked. Therefore this improved method of masking enables the component 20 shown in FIG. 8 to henceforth undergo further manipulation immediately following the removal of the low memory foil 34.

The above description is meant to be exemplary only, and one skilled in the art will recognize that changes may be made to the embodiments described without department from the scope of the invention disclosed. For example, the method of wrapping or masking the component may vary as may the number of layers of low memory foil employed. It is also understood that the present masking method could be used to mask workpiece other than turbine blades. For instance, it could be used to mask vanes or other difficult-to-hold/secure gas turbine engine components during various manufacturing operations, such as coating and welding. Still other modifications which fall within the scope of the present invention will be apparent to those skilled in the art, in light of a review of this disclosure, and such modifications are intended to fall within the appended claims.

The invention claimed is:

1. A method of masking a surface of a gas turbine engine component, the method comprising the steps of:

providing a masking member having the ability to retain the shape of the surface to which the masking member is applied, the masking member having substantially zero-shape memory such as to remain deformed after having been deformed with substantially no spring back to an original shape thereof; and using said ability as a primary attachment to releasably fix the masking member in position over the surface of the gas turbine engine component.

2. The method as defined in claim 1, wherein the masking member has an adhesive-free component engaging surface, and wherein the method comprises the step of: applying said adhesive-free component engaging surface directly against said surface of the gas turbine engine component, the frictional contact between the masking member and the surface of the gas turbine engine component after the deformation of the masking member retaining the masking member in position on the gas turbine engine component.

3. The method as defined in claim 1, wherein the gas turbine engine component comprises an airfoil, and wherein the method comprises the step of: wrapping said masking member in close fitting relation to said airfoil.

4. The method as defined in claim 1, wherein said masking member comprises a substantially zero-shape memory foil with no spring back memory, and wherein the method further comprising encapsulating the surface of the gas turbine engine component with the masking member thereon in hardenable casting material, the masking member preventing the casting material from entering into holes defined in the surface of the gas turbine engine component.

5. The method as defined in claim 4, wherein the low shape memory foil is an annealed nickel foil.

6. A method of temporarily protecting a surface of a gas turbine engine component while the same is being processed, the method comprising the steps of: fixing an adhesive-free foil in position on a surface of the gas turbine engine component by directly laying the foil against the surface in conformity to a shape of said surface, the adhesive-free foil having a substantially zero-shape memory, thereby allowing the adhesive-free foil to retain the shape imparted thereto, the shape imparted to the adhesive-free foil providing frictional contact between the adhesive-free foil and the surface, the frictional contact maintaining the adhesive-free foil in position on the gas turbine component, processing the gas turbine engine component, and removing the adhesive-free foil from said surface.

7. The method as defined in claim 6, comprising the step of: wrapping the adhesive-free foil in close fitting relation to the gas turbine engine component, and wherein the processing step includes the steps of encapsulating a wrapped portion of the gas turbine component in a body of hardenable material and machining a part of the component extending out of said body of hardenable material.

8. A method of holding a component during processing thereof, the method comprising the steps of:

providing a foil having a substantially zero-shape memory such as to have the ability to retain the shape of the component to which the foil is applied; and fixing the foil in position over a portion of the component by plastically deforming the foil in close fitting relation with the component, the plastic deformation of the foil over the portion of the component preventing withdrawal of the foil from the component, and encapsulating the portion of the component covered by the foil in a body of hardenable material, the foil preventing the hardenable material from plugging holes defined in the portion of the component.

9. The method as defined in claim 8, wherein the foil has an adhesive-free component engaging surface, and wherein the method comprises the step of: laying said adhesive-free component engaging surface directly against said surface of the gas turbine engine component, the frictional contact between the foil and the surface of the gas turbine engine component retaining the foil in position on the gas turbine engine component.

10. The method as defined in claim 8, wherein the gas turbine engine component comprises an airfoil, and wherein the method comprises the step of: wrapping said foil in close fitting relation to said airfoil.

11. The method as defined in claim 8, wherein the foil is an annealed nickel foil.

* * * * *